US007840153B2

(12) United States Patent
Semma et al.

(10) Patent No.: US 7,840,153 B2
(45) Date of Patent: Nov. 23, 2010

(54) IMAGE FORMING APPARATUS WITH A SUPPLEMENTAL POWER SUPPLY UNIT

(75) Inventors: Toshitaka Semma, Yamato (JP); Yoshihisa Kimura, Kawasaki (JP); Tetsuya Yano, Yokohama (JP); Norio Muraishi, Machida (JP); Naoki Sato, Yokohama (JP); Kazuhito Kishi, Yokohama (JP)

(73) Assignee: Ricoh Company, Limited, Tokyo (JP)

( * ) Notice: Subject to any disclaimer, the term of this patent is extended or adjusted under 35 U.S.C. 154(b) by 1006 days.

(21) Appl. No.: 11/522,324

(22) Filed: Sep. 18, 2006

(65) Prior Publication Data

US 2007/0071479 A1 Mar. 29, 2007

(30) Foreign Application Priority Data

Sep. 16, 2005 (JP) ..... 2005-271134
Sep. 8, 2006 (JP) ..... 2006-244443

(51) Int. Cl.
*G03G 15/00* (2006.01)
*G03G 15/20* (2006.01)

(52) U.S. Cl. ..... 399/88; 399/37; 399/70

(58) Field of Classification Search ..... 399/37, 399/39, 70, 88
See application file for complete search history.

(56) References Cited

U.S. PATENT DOCUMENTS 6,542,705 B2 4/2003 Fujita et al.
7,002,112 B2 2/2006 Kishi et al.
7,010,255 B2 3/2006 Yura et al.
7,054,570 B2 5/2006 Kishi et al.
2002/0043523 A1 4/2002 Fujita et al.
2004/0245235 A1 12/2004 Kishi et al.
2004/0245241 A1 12/2004 Kishi et al.
2004/0247334 A1 12/2004 Kishi et al.
2004/0258426 A1 12/2004 Kishi et al.
2005/0123314 A1 6/2005 Satoh et al.
2005/0123315 A1 6/2005 Kishi et al.
2005/0139584 A1 6/2005 Kishi et al.
2005/0139591 A1 6/2005 Takamatsu et al.

(Continued)

FOREIGN PATENT DOCUMENTS

JP 2004-236492 8/2004

*Primary Examiner*—David M Gray
*Assistant Examiner*—Rodney Bonnette
(74) *Attorney, Agent, or Firm*—Oblon, Spivak, McClelland, Maier & Neustadt, L.L.P.

(57) ABSTRACT

An image forming apparatus having (1) a main power supply unit (PSU), which converts an AC power source into an AC power and a first DC power, provides the AC power to a fusing unit, and provides the first DC power to a plurality of DC-powered units in the image forming apparatus, (2) a supplemental power supply unit, which accumulates the AC power source and provides a second DC power to the plurality of DC-powered units for a predetermined period, and (3) a controller, which increases or decreases the AC power to be provided to the fusing unit and selects the DC power source from the main PSU and the supplemental PSU by detecting that the supplemental PSU can provide the DC power to the plurality of DC-powered units or not. When the supplemental power supply unit can provide DC power to the Plurality of DC-powered units, the controller increases the AC power from the main power supply unit to the fusing unit and shortens the recovery time.

20 Claims, 17 Drawing Sheets

U.S. PATENT DOCUMENTS

2005/0167420 A1 8/2005 Sato et al.
2005/0175368 A1 8/2005 Matsusaka et al.
2005/0175370 A1 8/2005 Matsusaka et al.
2005/0189923 A1 9/2005 Ohishi et al.
2005/0191078 A1 9/2005 Kishi et al.
2005/0220474 A1 10/2005 Sato et al.
2005/0232651 A1 10/2005 Sato et al.
2006/0024079 A1 2/2006 Sato et al.
2006/0039713 A1 2/2006 Kishi et al.
2006/0051111 A1 3/2006 Kishi et al.
2006/0051112 A1 3/2006 Matsusaka et al.
2006/0051113 A1 3/2006 Kishi et al.
2006/0051119 A1 3/2006 Kishi et al.
2006/0051120 A1 3/2006 Kishi et al.
2006/0051121 A1 3/2006 Matsusaka et al.
2006/0127118 A1 6/2006 Kishi et al.
2007/0059016 A1* 3/2007 Sato et al. ..... 399/88

* cited by examiner

FIG. 5

| OPERATING STATE | SETTING OF SWITCHES | | |
|---|---|---|---|
| | SW5407 | SW5405 | SW5406 |
| STAND-BY MODE | ON | ON | ON |
| POWER SAVING MODE | OFF | ON | ON |
| OFF MODE | OFF | OFF | OFF |

FIG. 6

| OPERATING STATE | EXECUTABLE FUNCTION : O | | | | |
|---|---|---|---|---|---|
| | RECOVERY CONDITION DETECT | SCAN | COPY | PRINT | FAX SEND/ RECEIVE WITHOUT PRINTING | STORE |
| STAND-BY MODE | O | O | O | O | O | O |
| POWER SAVING MODE | O | O | | | O | O |
| OFF MODE | O | | | | | O |

FIG. 17

| INTERVAL OF SHEETS | PRINTING SPEED | AVERAGE NECESSARY POWER UNDER THE DISADVANTAGEOUS CONDITION |
|---|---|---|
| 90mm | 40 SHEETS/MINUTE | 900W |
| 270mm | 25 SHEETS/MINUTE | 700W |

FIG. 18

| PROCESS SPEED | PRINTING SPEED | AVERAGE NECESSARY POWER UNDER THE DISADVANTAGEOUS CONDITION |
|---|---|---|
| 200mm/s | 40 SHEETS/MINUTE | 900W |
| 125mm/s | 25 SHEETS/MINUTE | 700W |

IMAGE FORMING APPARATUS WITH A SUPPLEMENTAL POWER SUPPLY UNIT

CROSS-REFERENCE TO RELATED APPLICATIONS

This patent application is related to and claims priority under 35 U.S.C. §119 to Japanese patent application Nos. 2005-271134, filed Sep. 16, 2005, and 2006-244443, filed Sep. 8, 2006, the entire contents of which are incorporated herein by reference.

BACKGROUND OF THE INVENTION

1. Field of the Invention

This invention relates to an image forming apparatus with a supplemental power supply unit. The supplemental power supply unit supplies the DC power to a plurality of DC-powered units of the image forming apparatus during the predetermined period and enables to increase the AC power to the heater for fixation.

2. Discussion of the Background

An image forming apparatus like a copy, a printer, and a facsimile using an electrophotographic technology usually has a fusing unit to fix a toner image on a recording sheet to the recording sheet. The fusing unit is provided with a pair of rollers, a heater in at least one of the rollers and the controller that controls the heater on off in order to maintain a temperature of the roller.

The image forming apparatus is required to be able to print in a short time after the image forming apparatus is turned on or recovered from a power saving mode. Generally, the most important factor to achieve the fast recovery is to minimize a warm up time, which is the time that the temperature of the roller rises to a fusing temperature at the power on sequence, and a recovery time, which is the time that the temperature of the roller rises to the fusing temperature at the recovery sequence from the power saving mode.

Recently, the image forming apparatus is usually connected to the external device, like a PC, and is always turned on, therefore shortening the recovery time from the power saving mode is considered very important.

In order to achieve a fast recovery, supplying much power to the fusing unit is one of solutions but the power, which can obtain from the AC outlet, is strictly limited by the law.

In Japanese Open-Laid Patent 2004-236492, the image forming apparatus, which has a supplemental power supply unit (PSU) and supplies DC power to the image forming apparatus from the supplemental PSU when the total amount of DC power consumption is predicted to exceed the limit, is disclosed. This type of image forming apparatus can equalize the power consumption, but do not aim to provide fast recovery.

SUMMARY OF THE INVENTION

In light of the above described problem, the present invention provides an image forming apparatus having (1) a main power supply unit (PSU), which converts an AC power source into an AC power and a first DC power, provides the AC power to the fusing unit, and provides the first DC power to a plurality of DC-powered units in the image forming apparatus, (2) a supplemental power supply unit, which accumulates the AC power source and provides a second DC power to the plurality of DC-powered units for a predetermined period, and (3) a controller, which increases or decreases the AC power to be provided to the fusing unit and selects the DC power source from the main PSU and the supplemental PSU by detecting that the supplemental PSU can provide the DC power to the plurality of DC-powered units or not. When the supplemental power supply unit can provide DC power to the plurality of DC-powered units, the controller increases the AC power from the main power supply unit to the fusing unit and shortens the recovery time.

BRIEF DESCRIPTION OF THE DRAWINGS

In order that the present invention may be more clearly understood, it will now be disclosed in greater detail with reference to the accompanying drawings, wherein:

FIG. 5 is a table showing a relationship between operation states of the image forming apparatus and on-off states of the SW5405 through SW5407;

FIG. 6 is a table showing executable functions in each operating state of the image forming apparatus;

FIG. 17 is a table showing the average necessary power under the low ambient temperature, the paper interval, and the printing speed;

FIG. 18 is a table showing the average necessary power under the low ambient temperature, the process speed, and the printing speed.

DESCRIPTION OF THE PREFERRED EMBODIMENTS

Figure 1:
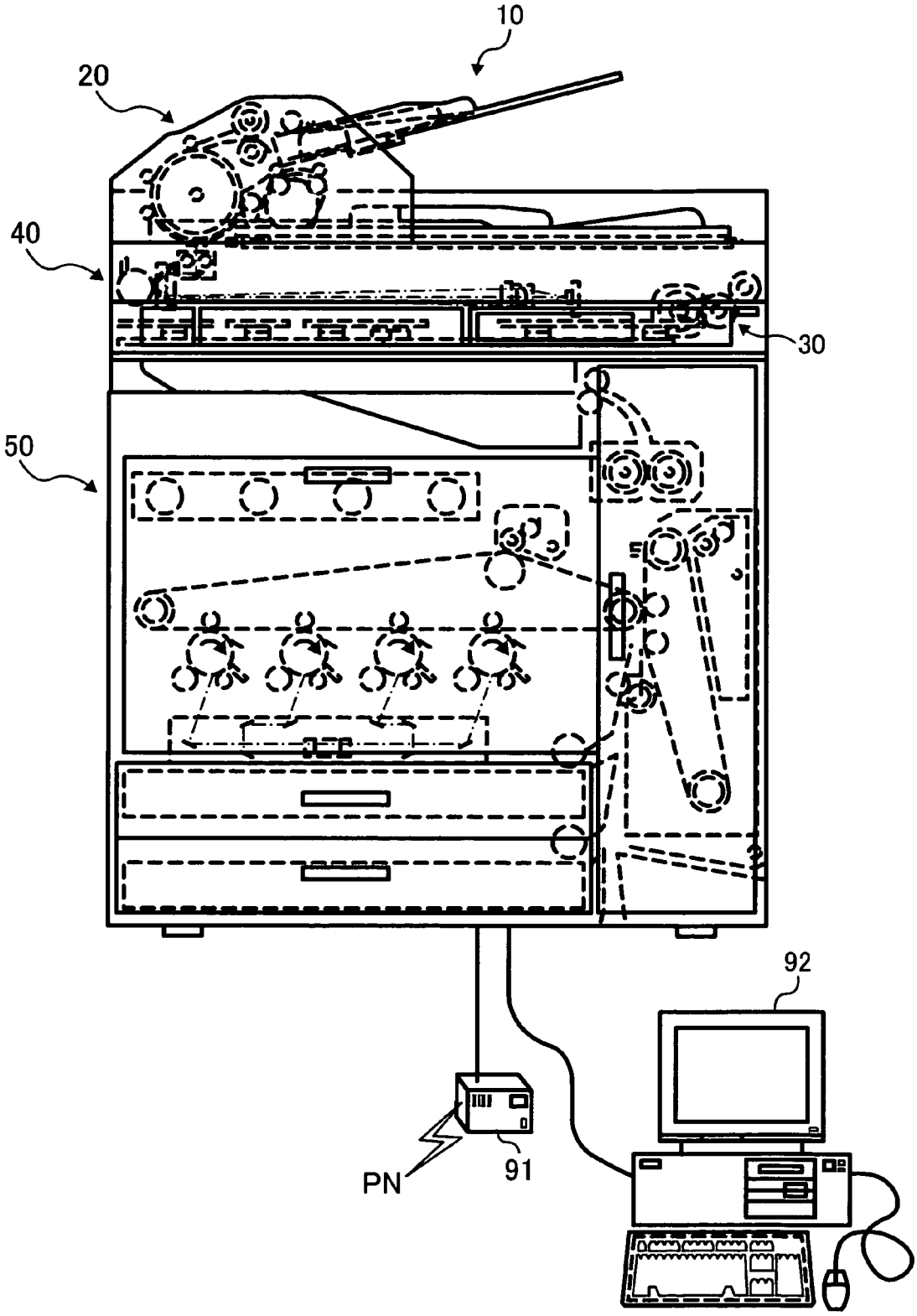
FIG. 1 is an overall view illustrating an image forming apparatus, a PC, and a telephone switching apparatus.

Referring to FIG. 1, an image forming apparatus 10 is explained. As illustrated in FIG. 1, the image forming apparatus 10 is provided with an automatic document feeder (ADF) 20, an operational panel 30, a scanner unit 40, and a printer unit 50. The operational panel 30 and the scanner unit 40 with the ADF 20 are separable from the printer unit 50.

The scanner unit 40 is provided with a scanner controller (not shown), which controls motors, clutches, and solenoids based on sensor inputs of the ADF 20 and the scanner unit 40. The scanner controller communicates with a CPU 502 on an engine controller 501 (shown in FIG. 3) directly or indirectly, and controls scanning of original documents.

A main controller 80 (shown in FIG. 3) in the image forming apparatus 10 is connected to a personal computer (PC) 92 through a local area network (LAN) 93, and a facsimile control unit (FCU) 90 (shown in FIG. 3) in the image forming apparatus 10 is connected to a telephone switching apparatus (PBX) 91, which provides a connection to a public telephone network (PN).

Figure 2:
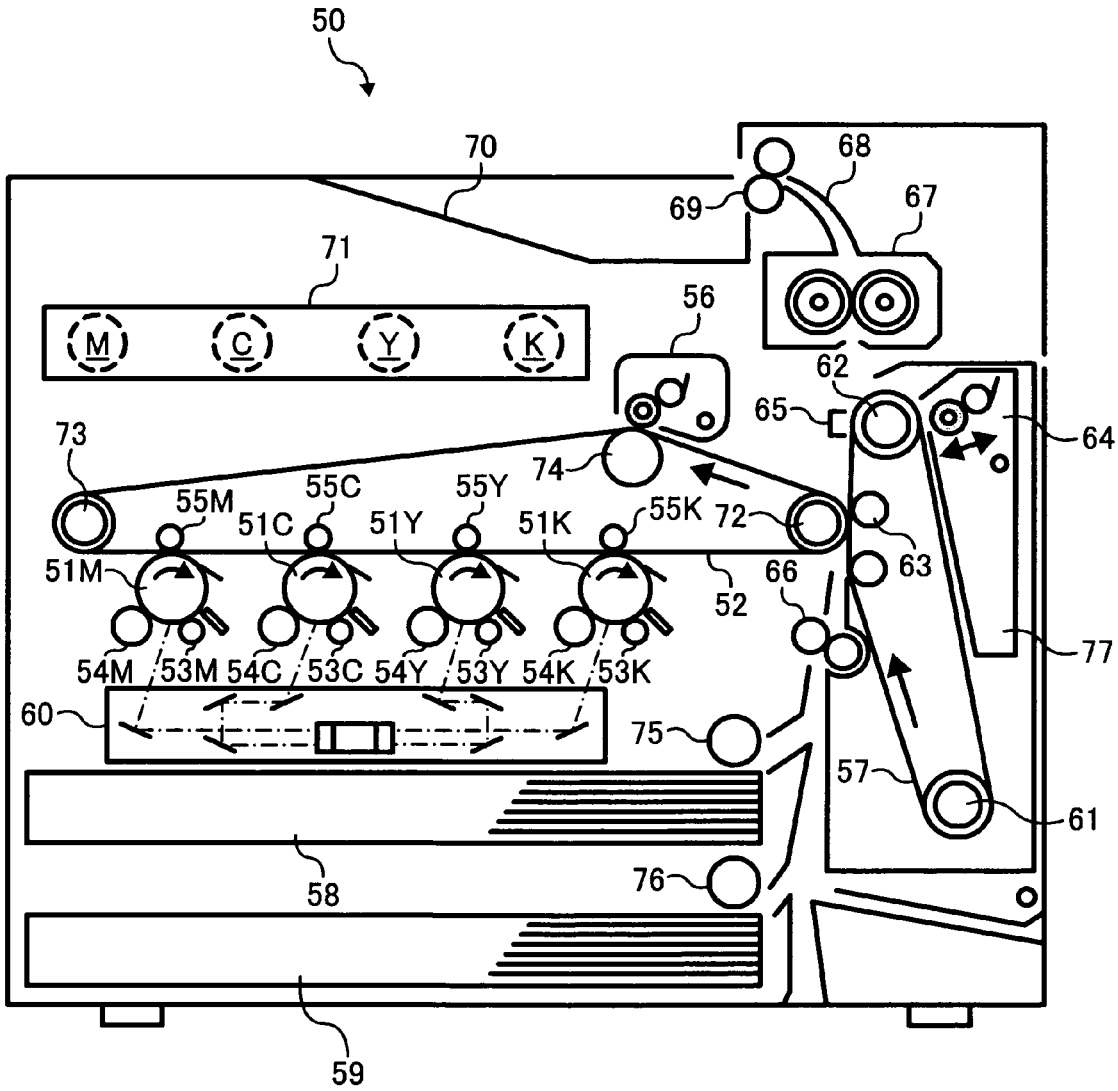
FIG. 2 is a perspective view illustrating a structure of a printer unit of the image forming apparatus.

FIG. 2 shows structures of the printer unit 50. The printer unit 50 is provided with a color image forming mechanism, which is a so-called tandem type, further explained below. The image forming mechanism for each color, magenta (M), cyan (C), yellow (Y), and black (K) are placed from left to right along a first transfer belt 52. The first transfer belt moves along the arrow direction shown in FIG. 2.

Around a rotatively supported photosensitive drum for magenta 51M, a quenching unit (not shown), a charging unit 53M, and a developing unit 54M are arranged. Between the charging unit 53M and the developing unit 54M, a beam path for a laser beam from an optical writing unit 60 is placed. The structure of the image forming mechanism for each color is identical, except for the color of the toner in the developing unit 54M, 54C, 54Y, and 54K. A part of each photosensitive drum 51M, 51C, 51Y, and 51B contacts with the first transfer belt 52. In this embodiment, a drum shape of the photosensitive member (the photosensitive drum 51) is adopted, but in other embodiment it can be a belt shape (a photosensitive belt).

Supporting rollers 73, 74, and a driving roller 72 support the first transfer belt 52 by giving tension to it. The driving roller 72 gives the driving force to the first transfer belt 52 and rotates it in the arrow direction. Inside of the first transfer belt 52, first transfer roller 55M, 55C, 55Y, and 55K are placed the opposite side of the photosensitive drum 51M, 51C, 51Y, and 51B. Outside of the first transfer belt 52, a first cleaning unit 56 is located and the first cleaning unit 56 cleans residual toner on the first transfer belt 52 after a toner image is transferred to a recording sheet or a second transfer belt 57.

The optical writing unit 60 emits four laser beams and each of the beams is modulated in accordance with corresponding color data. Four laser beams scan the surfaces of each of the photosensitive drums 51, which are evenly charged by the charging units 53, and form electrostatic latent images. In this embodiment, the optical writing unit 60 is explained as the laser scanning system, but a LED (Laser Emitting Diode) array system is also a possible embodiment.

At the right side of the first transfer belt 52, the second transfer belt 57 is located. The first transfer belt 52 and the second transfer belt 57 contact each other and form a transfer nip with a predetermined size. A driving roller 61 and a supporting roller 62 support the second transfer belt 57 and the second transfer belt 57 moves in the arrow direction shown in FIG. 2. A second transfer roller 63 is placed inside of the second transfer belt 57 and a second cleaning unit 64 and a transfer charging unit 65 is placed outside of the second transfer belt 57.

The second cleaning unit 64 cleans residual toner on the second transfer belt 57 after a toner image is transferred to a recording sheet. Sheet trays 58 and 59 contain the recording sheets and a feeding roller 75 or 76 conveys the uppermost sheet to a registration roller 66.

A fusing unit 67, a discharging guide 68, and a discharging roller 69 are provided in the upper area of the second transfer belt 57 and form the recording sheet path to a stacker 70. In the area between the first transfer belt 52 and the stacker 70, toner cartridges 71 for each color are placed and pump motors (not shown) convey the toners to the corresponding developing units 54.

First, the image forming process done in the printer unit 50 for the duplex and the color mode is explained. The beam corresponding to the magenta image data from the optical writing unit 60 scans the surface of the photosensitive drum 51M, which is evenly charged by the charging unit 53M, and forms the electrostatic latent image. The electrostatic latent image is developed by the developing unit 54M and the toner image is formed on the photosensitive drum 51M. The toner image is transferred from the photosensitive drum 51M to the first transfer belt 52, which makes synchronous movement with the photosensitive drums 51, by the transfer roller 55M. The residual toner on the surface of the photosensitive drum 51M is removed by a drum cleaning unit (not shown) and the photosensitive drum 51M prepares for the next image forming cycle.

The first transfer belt 52 holds the magenta toner image and moves to the left. On the photosensitive drum 51C, the cyan toner image is formed by the image forming cycle mentioned above and the cyan toner image is transferred on the magenta toner image by the transfer roller 55C. The same image forming cycle occurs on the photosensitive drum 51Y and 51B and the yellow and black toner image is transferred to the first transfer belt 52 and finally a full color toner image is formed on the first toner belt 52. In a black and white mode, only the black toner image is formed by the image forming cycle mentioned above. The color toner image on the first transfer belt 52 is transferred to the second transferred belt 57 by the transfer roller 63 at the transfer nip. In the color mode, the toner images of each color are formed simultaneously and transferred to the first transfer belt 52 and form a color toner image.

The first transfer belt 52 continues to rotate and the color toner image for the other side of the recording sheet is also formed in the following image forming cycle. Synchronized with the movement of the first transfer belt 52, the feeding roller 75 or 76 starts to feed the recording sheet. The uppermost sheet of the plurality of sheets stocked in the sheet tray 58 or 59 is sent to the registration roller 66, and the registration roller 66 sends the recording sheet to the transfer nip. This time at the transfer nip, the color toner image is transferred to the one side of the recording sheet by the transfer roller 63. After conveying the recording sheet to an upper direction, then the color toner image on the second transfer belt 57 is transferred to the other side of the recording sheet by the transfer charging unit 65. The recording sheet feeding occurs in accordance with the color toner image transfer from the first transfer belt 52 and the second transfer belt 57.

The recording sheet is sent to the fusing unit 67 and the color toner images are fixed on both sides of the recording sheet. The recording sheet continues to be conveyed through the discharging guide 68 and the discharging roller 69 discharges the recording sheet to the stacker 70. In the duplex image forming process mentioned above, the lower side image of the recording sheet on the stacker 70, which is transferred directly from the first transfer belt 52, is formed later during the image forming process and the upper side image of the recording sheet on the stacker 70, which is transferred from the second transfer belt 57, is formed earlier during the image forming process. Accordingly, in order to sort the page order, at first, the toner image of the second page needs to be formed on the transfer belt 52 and transferred to the second transfer belt 57. After that the toner image of the first page needs to be formed on the first transfer belt 52.

Furthermore, the toner image transferred from the second transfer belt 57 needs to be a mirror image on the photosensitive drums 51. Writing and reading control for a frame memory 81 and a work memory 87 done in the main controller 80 are realized using the page control and mirror imaging processing mentioned above.

After transfer of the color toner image from the second transfer belt 57 to the recording sheet, the second cleaning unit 64, which is provided with a brushing roller 78, a retrieving roller (not shown), and a blade (not shown), removes residual toner and paper dust.

In FIG. 2, the brushing roller 78 is in the detached position. The brushing roller 78 is structured to be able to move in the arrow direction shown in FIG. 2 and can be attached to the second transfer belt 57. If the color toner image is not transferred to the recording sheet and is still on the second transfer belt 57, then the brushing roller 78 is maintained in the detached position. After transfer of the color toner image is done, the brushing roller 78 is maintained in the attached position and cleans the residual toner and the paper dust on the second transfer belt 57. The retrieved residual toner and the paper dust are collected in a waste toner holder 77.

In the image forming process for the duplex mode, the above-described process is always done in the printer unit 50.

For the one-sided page mode, there are two modes. One mode is called the second transfer belt mode, which uses both the first transfer belt 52 and the second transfer belt 57. The other mode is called the first transfer belt mode, which uses only the first transfer belt 52 to get a one-sided print. When the second transfer belt mode is selected, the color toner image or the black toner image formed on the first transfer belt 52 is transferred to the second transfer belt 57, and furthermore transferred to the recording sheet. In this mode, the image is on the upper side of the recording sheet on the stacker 70.

When the first transfer belt mode is selected, the color toner image or the black toner image formed on the first transfer belt 52 is transferred directly to the recording sheet. In this mode, the image is on the lower side of the recording sheet on the stacker 70.

Figure 3:
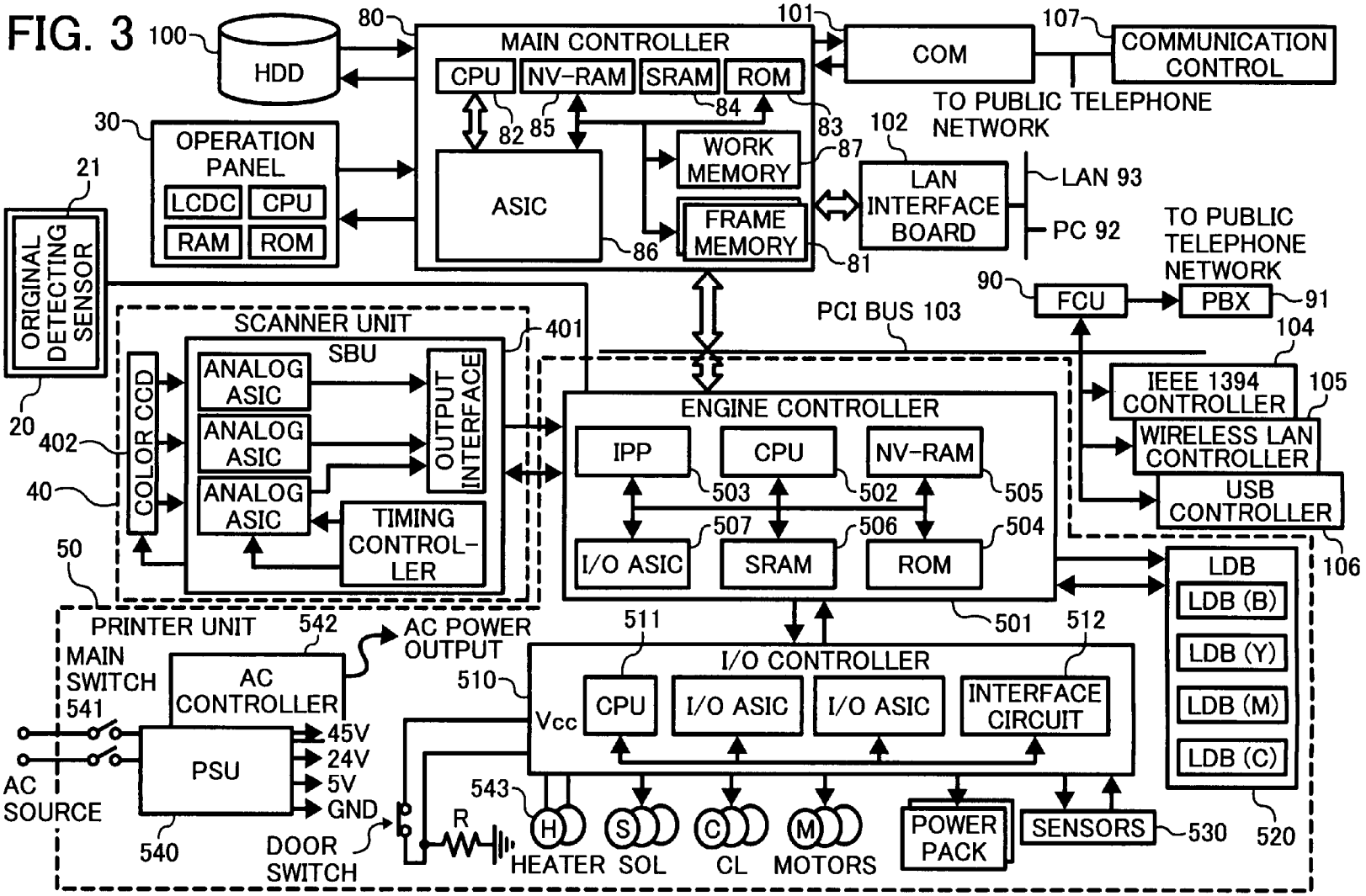
FIG. 3 is a block diagram illustrating main electrical parts of the image forming apparatus.

Referring to FIG. 3, a diagram of an electrical system of the image forming apparatus 10 is shown. The electrical system is provided with a main controller 80 that controls the image forming apparatus 10 entirely, the operational panel 30 connected to the main controller 80, a Hard Disk Drive (HDD) 100 that stores the image data, a communication control interface board (COM) 101 that communicate with an external device through the analog telephone line, a LAN interface board 102, a facsimile controller (FCU) 90, a IEEE1394 controller 104, a wireless LAN controller 105, a USB controller 106, the controllers being connected to a PCI bus 103, the engine controller 501 connected to the main controller 80 through the PCI bus 103, the ADF 20, an Input& Output (I/O) controller 510 connected to the engine controller 501 and controls mechanical and electrical parts in the image forming apparatus 10, a sensor board unit (SBU) 401 that processes an image data of an original, and a laser diode board (LDB) 520 that emits the laser beam based on the image data to the photosensitive drums 51.

The ADF 20 has an original detecting sensor 21, which detects whether the original is on the ADF 20 or not. The original detecting sensor sends a detecting result to the engine controller 501.

The scanner unit 40 scans an original with a light source and focuses reflection to a color CCD (charge coupled device) 402. The CCD 402 changes an optical signal based on the reflection of the original to electrical red (R), green (G), blue (B) image data.

The communication control interface board (COM) 101 communicates with an external remote diagnosis center (not shown) and enables a serviceperson to know where a malfunction occurs and how a situation is so as to repair the image forming apparatus 10 in early stage. The communication control interface board (COM) 101 also informs operating conditions to the external remote diagnosis center.

The color CCD 402, shown in FIG. 3, is a 3-line type CCD and generates an even pixel channel (EVENch) and an odd pixel channel (ODDch) of R, G, and B image signals. The signals are sent to an analog ASIC (application specific integrated circuit) on he SBU 401. The SBU 401 also has a timing controller for the analog ASIC, CCD 402. The analog ASIC is provided with a sample-and-hold circuit, an analog-to-digital converter, and a shading correction circuit, and changes the signals from the CCD 402 to the R, G, and B image data. An output interface outputs the R, G, and B image data to an IPP (image processing processor) 503.

The IPP 503 is a programmable operational processor that executes an image processing, such as a character/photograph area recognition, a ground level noise removal, a scanner gamma conversion, a filtering processing, a color correction, a magnification/reduction, a image modification, a printer gamma correction, and a multi-level output processing to the R, G, and B image data. After deterioration of the R, G, and B image date are corrected in the IPP 503, the R, G, and B image date are stored in the frame memory 81 on the main controller 80.

The main controller 80 is provided with a CPU 82, a ROM 83, which stores programs for the CPU 82, a SRAM 84, which is used as a work area for the CPU 82, a NV-RAM 85, which has a built-in lithium battery and backs up the data stored in the SRAM 84 when the power is turned off, an ASIC 86, which controls a data timing between the CPU 82 and the ROM 83, SRAM 84, and NV-RAM 85, and also controls a data flow of a frame memory 81, and the work memory 87.

The main controller 80 offers many applications, e.g., scanner application, a facsimile application, a printer application, and copy application, and controls the entire image forming apparatus 10. The main controller 80 also recognizes inputs from the operational panel 30 and displays settings at the operational panel 30.

Many units are connected to the PCI bus 103. In the PCI bus 103, the image data and control commands are transferred by a time-sharing method. The communication control interface board (COM) 101 interfaces between a communication controller 107 and the main controller 80. The interface between the communication control interface board (COM) 101 and the main controller 80 is adopted an asynchronous full-duplex transmission interface and the interface between the communication control interface board (COM) 101 and the communication controller is adopted a standard RS-485 interface. The communication with the external remote diagnosis center is achieved through the communication control interface board (COM) 101. The LAN interface board 102 is connected to the LAN 93. The LAN interface board 102 is provided with a physical layer (PHY) controlling chip and interfaces between the main controller 80 and the LAN 93. The communication between the LAN interface board 102 and the main controller 80 uses a standard $I^2C$ interface, and the main controller 80 communicates with an external device through the LAN interface board 102.

The HDD 100 stores system programs for controlling the image forming apparatus 10, system settings for printer mechanisms and image forming mechanisms, image data read by the scanner unit 40 or send to the LDB 520, and document data from external devices. The HDD 100 is connected to the main controller 80 through the interface based on the ATA/ATAPI-4 standard.

The operational panel 30 is provided with a CPU, ROM, RAM, LCD (not shown), and LCDC (LCD controller), which is an ASIC, and controls inputs from keys and outputs for the LCD. The ROM stores the control program for the operational panel 30 to recognize inputs from keys and to display the information based on the inputs. The RAM is a work memory for the CPU. The operational panel 30 communicates with the main controller 80, which means the operational panel 30 sends the inputs by an operator to the main controller 80 and displays the information to the operator based on the commands from the main controller 80.

Image data for each color (B, C, M and Y) from the work memory 87 on the main controller 80 are sent to the LDB 520. In the LDB 520, the current modulation is made based on the image data and modulated currents are supplied to laser diodes corresponding to each color on the LDB 520.

The engine controller 501, mainly controls the image forming process done in the printer unit 40, is provided with a CPU 502, the IPP 503, a ROM 504, a SRAM 506, a NV-RAM 505 and input/output (I/O) control ASIC 507. The NV-RAM 505 has both a SRAM section and an EEPROM section, and backs up the data in the SRAM section to the EEPROM section when the power is down. The I/O ASIC 507 has a serial interface with the CPU 502 and controls part of various actuators, e.g., counters, fans, solenoids and motors, near the engine controller 501. The engine controller 501 and the I/O controller 510 are connected by a synchronous serial interface.

The I/O controller 510 is provided with a CPU 511 and detects a temperature of the fusing unit 67, an output voltage of a capacitor PSU 5401 (shown in FIGS. 4 and 9), a toner density on the photosensitive drums 51, a toner density in the developing unit 54, and sheet jams in a sheet path by many sensors 530. Based on the detection results by the sensors 530, the I/O controller 510 controls various actuators, e.g., heater 543, solenoids, clutches, motors and high voltage PSU through an interface circuit 512.

A PSU 540 supplies outputs DC voltages to the image forming apparatus 10. When a main switch 541 (shown in FIGS. 3, 4, and 9) is closed, a power source from an outlet is supplied to both the PSU 540 and an AC control circuit 542 and the AC control circuit starts to provide AC power to the heater 543 (shown in FIG. 3, 4) of the fusing unit 67. The PSU 540 consists of two parts, one is a main PSU that supplies the DC power to the image forming apparatus 10, and the other is a supplemental PSU 5401 based on an accumulated power in a capacitor unit 5408.

Figure 4:
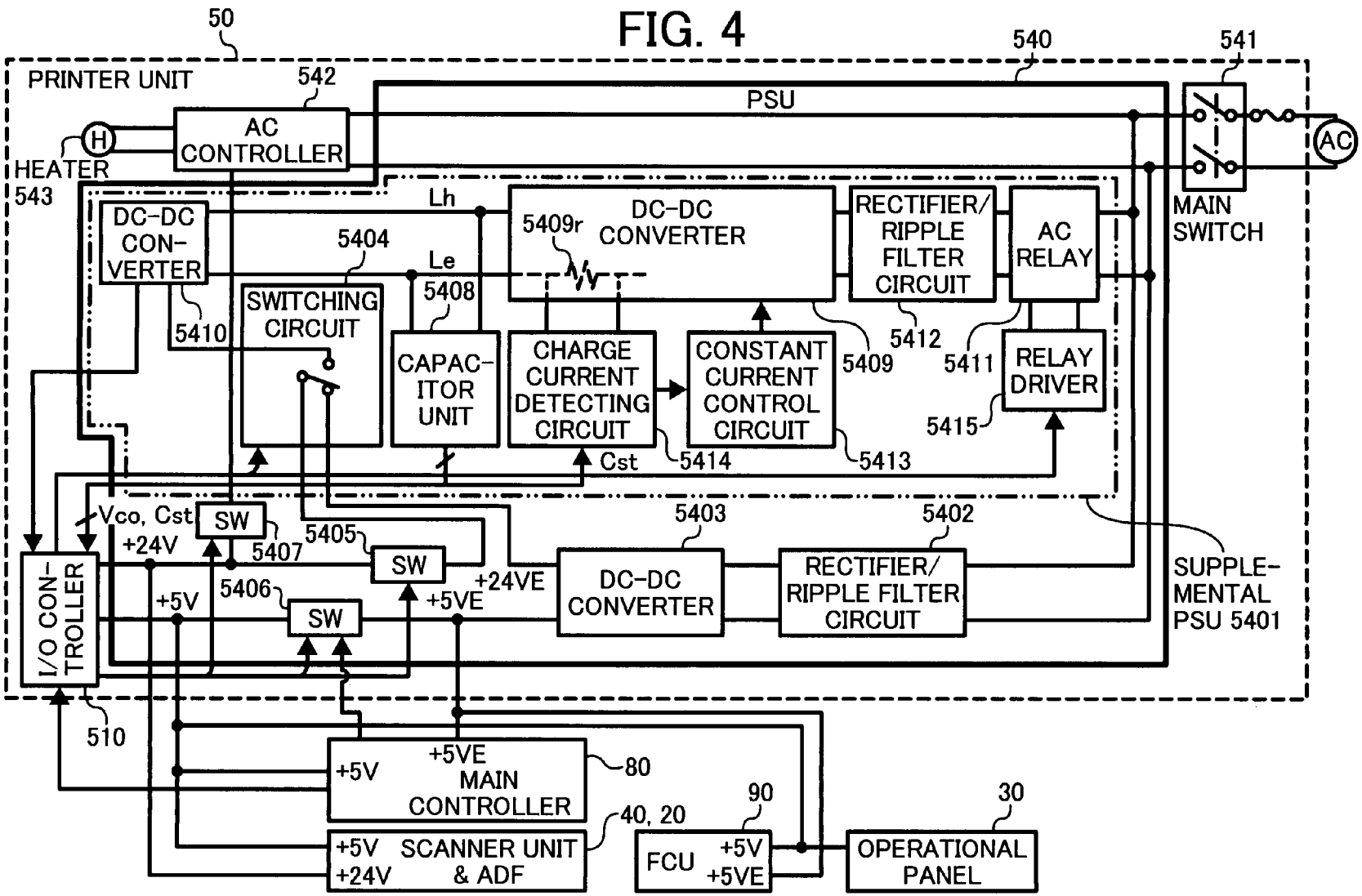
FIG. 4 is a block diagram illustrating the PSU shown in the FIG. 3 according to one embodiment of the invention.

FIG. 4 shows a block diagram of the PSU 540. Referring to FIG. 4, when the main switch 541 is closed, the power source from the outlet is supplied to a rectifier/ripple filter circuit 5402, an AC relay 5411 and the AC control circuit 542. The DC output of the rectifier/ripple filter circuit 5402 is supplied to a DC-DC converter 5403 and the DC-DC converter 5403 outputs regulated DC 24V (+24VE) and regulated DC 5V (+5VE) in this embodiment.

In the PSU 540, +24VE, the output of the DC-DC converter 5403, connected to a switch 5405 through a switching circuit 5404 and +5VE is connected to a switch 5406. The AC control circuit 542, which controls on/off of the heater 543 of the fusing unit 67, has a relay (not shown) and DC +24V is supplied through a switch 5407 to the relay of the AC control circuit 542. The power source from the outlet is supplied to a triac by closing the relay. The I/O controller 510 controls the on duty of the triac based on the temperature of the fusing unit 67 so that the temperature becomes and is maintained at a target temperature.

The switch 5406 is a self-maintainable type switch. A control signal from the main controller 80 indicates the on state then the switch 5406 maintains the on state and +5VE from the DC-DC converter 5403 is supplied to each controller and a control signal from the I/O controller 510, which is originally outputted by the CPU 502 of the engine controller 501, indicates the off state, then stops supplying the +5VE to each controller. The +5VE is supplied to a monitor circuit, which monitors the return conditions for returning to an operational mode during a power saving mode, and the part of the main controller 80. As +5V from the switch 5406 is supplied to the engine controller 501 and the I/O controller 510, the engine controller 501 and the I/O controller 510 start to work after the main controller 80 turns on the switch 5406 in order to recover the operational mode from the power saving mode.

The CPU 502 on the engine controller 501 gives controlling signals to change the on/off state of the switch 5407 and 5405 through the I/O controller 510. The CPU 502 on the engine controller 501 sends the controlling signals based on an on-off command from the CPU 82 on the main controller 80. When the image forming apparatus 10 goes to the operational mode from the power saving mode, the CPU 82 on the main controller 80 sends the on-off command in order to change the on-off states of the switch 5407 and 5405, and vice versa.

The switches 5405, 5406, and 5407 are set to the on state in a stand-by mode, in which the temperature of the fusing unit 67 is kept a little below the fusing temperature and the image forming apparatus 10 can start an image forming process without delay in response to a copy start command from the operational panel 30 or a print start command from the PC 92. In the stand-by mode, all functions, which the image forming apparatus 10 has, are executable.

The switch 5407 is set to the off state in the power saving mode, and stops supplying +24V to the AC controller 542, while the switch 5405, 5406 are set to the on state. The relay on the AC controller 542 comes to the off state without a supply of +24V and stops supplying the AC power to the heater 543 in the fusing unit 67. In the power saving mode, the switch 5405 and 5406 remain in the on state and supply +24V and +5V to the image forming apparatus so that the image forming apparatus 10 can perform some applications without image forming, such as scanning, storing image in the HDD 100, or facsimile transmission.

The switches 5405, 5406, and 5407 are set to the off state in an off mode, and stop supplying +24V and +5V to the image forming apparatus. But +5VE is supplied to an ADF detect sensor (not shown), a power save key on the operational panel 30, a circuit for receiving the print command from the PC 93, and a circuit for detecting an incoming facsimile communication from FCU 90. When one of these recovery conditions is satisfied, then the operation mode of the image forming apparatus 10 changes from the off mode to the stand-by mode.

FIG. 5 shows the relationship between the operating state of the image forming apparatus and the on-off state of the SW5405, 5406 and 5407. FIG. 6 is a table showing the executable functions in each operating state of the image forming apparatus.

The PSU 540 is provided with the supplemental PSU 5401, which supplies +24VE based on the power accumulated by a capacitor unit 5408. The detailed structure of the capacitor unit 5408 will be described later based on FIG. 7. The capacitor unit 5408 is connected to a DC-DC converter 5409 and a DC-DC converter 5410. The DC-DC converter 5409 is supplied the DC power from a rectifier/ripple filter circuit 5412, which is connected to the AC power source through the AC relay 5411. The AC relay 5411 controls its on-off by the I/O controller 510 through a relay driver 5415. The I/O controller 510 turns on the AC relay 5411 when the capacitor unit 5411 needs to be charged. The I/O controller 510 turns off the AC relay 5411 when the capacitor unit 5411 does not need to be charged and stops supplying the power to the DC-DC converter 5409.

A constant current control circuit 5413 gives a switching (PWM) pulse to a primary wire of a transformer (not shown) in the DC-DC converter 5409. A charge current detecting circuit 5414 detects a charging current by detecting a voltage difference between both ends of a detecting resistor 5409*r*, which is located at the secondary wire of the transformer in the DC-DC converter 5409 and feeds back the detected charging current to the constant current control circuit 5413. The constant current control circuit 5413 controls a duty of the PWM pulse to the DC-DC converter 5409 in order that the detected charging current corresponds with a designated current.

The charging current detecting circuit 5414 has a first amplifier, which has a low amplitude and a second amplifier, which has a high amplitude and a analog switch, which selects and feeds back a output of the first amplifier or a output of the second amplifier to the constant current control circuit 5413. When a charging state monitoring signal Cst, explained later in more detail, is a high level, which means all of the capacitor cells charged below a prefixed voltage VS2, then the charging current detecting circuit 5414 outputs the signal of the first amplifier to the constant current control circuit 5413. When a charging state monitoring signal Cst is a low level which means at least one of the capacitor cells charged to the prefixed voltage VS2, then the charging current detecting circuit 5414 outputs the signal of the second amplifier to the constant current control circuit 5413. Consequently, the constant current control circuit 5413 makes the charging current high when all of capacitor cells are charged below prefixed voltage VS2, and makes the charging current low when at least one of the capacitor cells is charged to prefixed voltage VS2.

Figure 7:
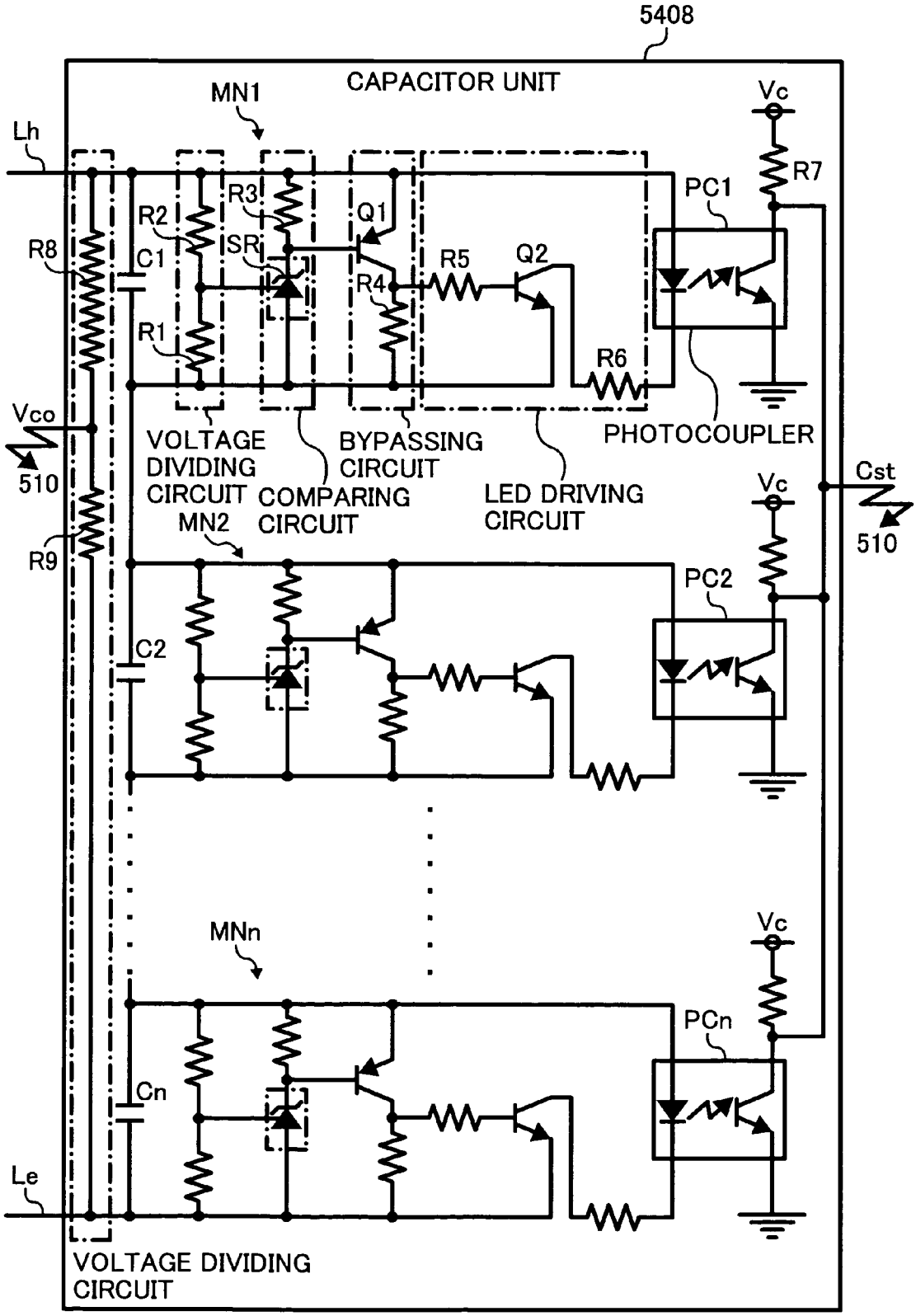
FIG. 7 is a circuit diagram of a capacitor unit shown in FIG. 4.

FIG. 7 shows a detailed circuit diagram of the capacitor unit 5408 shown in FIG. 4. In this embodiment, the capacitor unit 5408 consists of serially connected 18 electric double layer capacitor cells (C1 through Cn, n=18), which have rating voltage 2.5V and 600 F capacitance and are connected between lines Lh and Le. A rating voltage between lines Lh and Le (Vco) becomes 45V (2.5V×18). Each capacitor cell of C1 to Cn has a charged voltage monitoring circuit MN1 to MNn whose structure and characteristic are the same. The charged voltage monitoring circuit MN1 is provided with a voltage dividing circuit R1 and R2, a comparing circuit SR and R3, a bypassing circuit Q1 and R4, an LED driving circuit R5, Q2 and R6, a photocoupler PC1, and a current limiter R7. The output signals of the charged voltage monitoring circuit MN1 to MNn are connected in wired OR. Accordingly, when all the output signals of the charged voltage monitoring circuit MN1 to MNn are lower than the predetermined voltage VS2, then the charging state monitoring signal Cst shows high level, but if at least one output signal of the charged voltage monitoring circuit MN1 to MNn reaches the predetermined voltage VS2, then the charging state monitoring signal Cst turns into low level.

For example, the DC-DC converter 5409 charges the capacitor unit 5408 with a charging voltage 45V and a constant charging current 10A in the charging process. After one of the charged voltages of the capacitor cell (for example C1) reaches the predetermined voltage VS2, then the shunt regulator SR of the charged voltage monitoring circuit MN1 turns on and leads a PNP type transistor Q1 to turn on. As the transistor Q1 bypasses the charging current, the charging process for the capacitor cell C1 stops. Also turning on the transistor Q1 causes a NPN transistor Q2 to turn on and the LED emits the light to the photo transistor of the photo coupler PC1. As the photo coupler turns on, the charging state monitoring signal Cst changes from high level to low level.

The predetermined voltage VS2 is slightly lower than the rated voltage of capacitor cell C1 and is decided based on a formula (1) shown below by the resistance of the resistor R1,R2 and the reference voltage of the shunt regulator SR (VR1).

$$VS2=VR1(1+R2/R1) \quad (1)$$

The switching circuit 5404 in the PSU 540 switches +24V from DC-DC converter 5403 or +24V from DC-DC converter 5410 and outputs to the switch 5405.

In order to detect the capacitor voltage of the capacitor unit 5408, resistors R8 and R9 are connected between the line Lh and the line Le and divide the voltage. The I/O controller 510 detects the divided voltage as a capacitor voltage.

Figure 8:
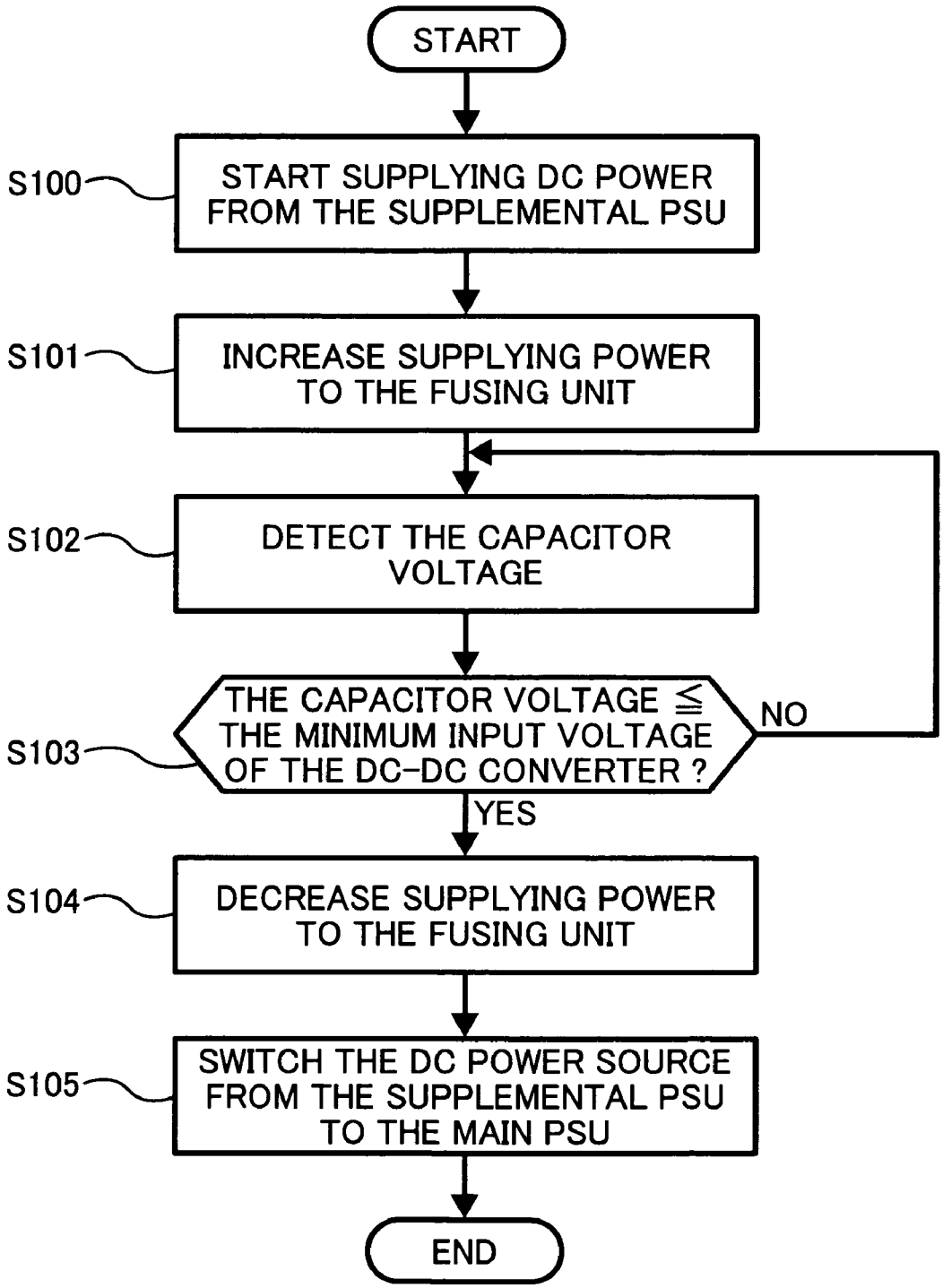
FIG. 8 is a flow chart explaining power control software according to one embodiment of the invention.

FIG. 8 shows a flow chart of one embodiment of this invention. First, the switching circuit 5404 selects the +24VE from the supplemental PSU 5401 (S100). In other words, +24VE from the DC-DC converter 5403 is not supplied to the SW 5405.

Then the AC controller 542 increases the supplying power to the heater 543 in the fusing unit 67 (S101). Therefore, the temperature of the fusing unit 67 rises and reaches the fusing temperature rapidly. While the supplemental PSU 5401 supplies +24VE, the I/O controller 510 detects the capacitor voltage Vco, which is equal to the input voltage of the DC-DC converter 5410 (S102).

The I/O controller 510 judges that the capacitor voltage Vco is higher or equal to a minimum input voltage of the DC-DC converter 5410 (S103). As supplying +24VE, the capacitor unit 5408 loses the accumulated power gradually and the capacitor voltage Vco gradually become lower.

When the capacitor voltage Vco reaches the minimum input voltage of the DC-DC converter 5410, the AC controller 542 reduces the supplying power to the heater 543 (S104). Then the switching circuit 5404 selects the +24VE from the DC-DC converter 5403 and stop supplying +24VE from the supplemental PSU 5408 (S105). The minimum input voltage of the DC-DC converter 5410 is determined by considering the switching time by the switching circuit 5404.

In this embodiment, the capacitor voltage is detected while the DC-DC converter 5410 of the supplemental PSU 5401 supplies the DC power and the AC power for the fusing unit 67 is increased. When the capacitor voltage drops to the predetermined voltage, the DC power for some DC loads is switched to the DC power from the DC-DC converter 5403 and the AC power for the fusing unit 67 is decreased. Therefore it is possible to supply much AC power for the fusing unit 67 and to make the warm-up time and the recovery time shorter.

Figure 9:
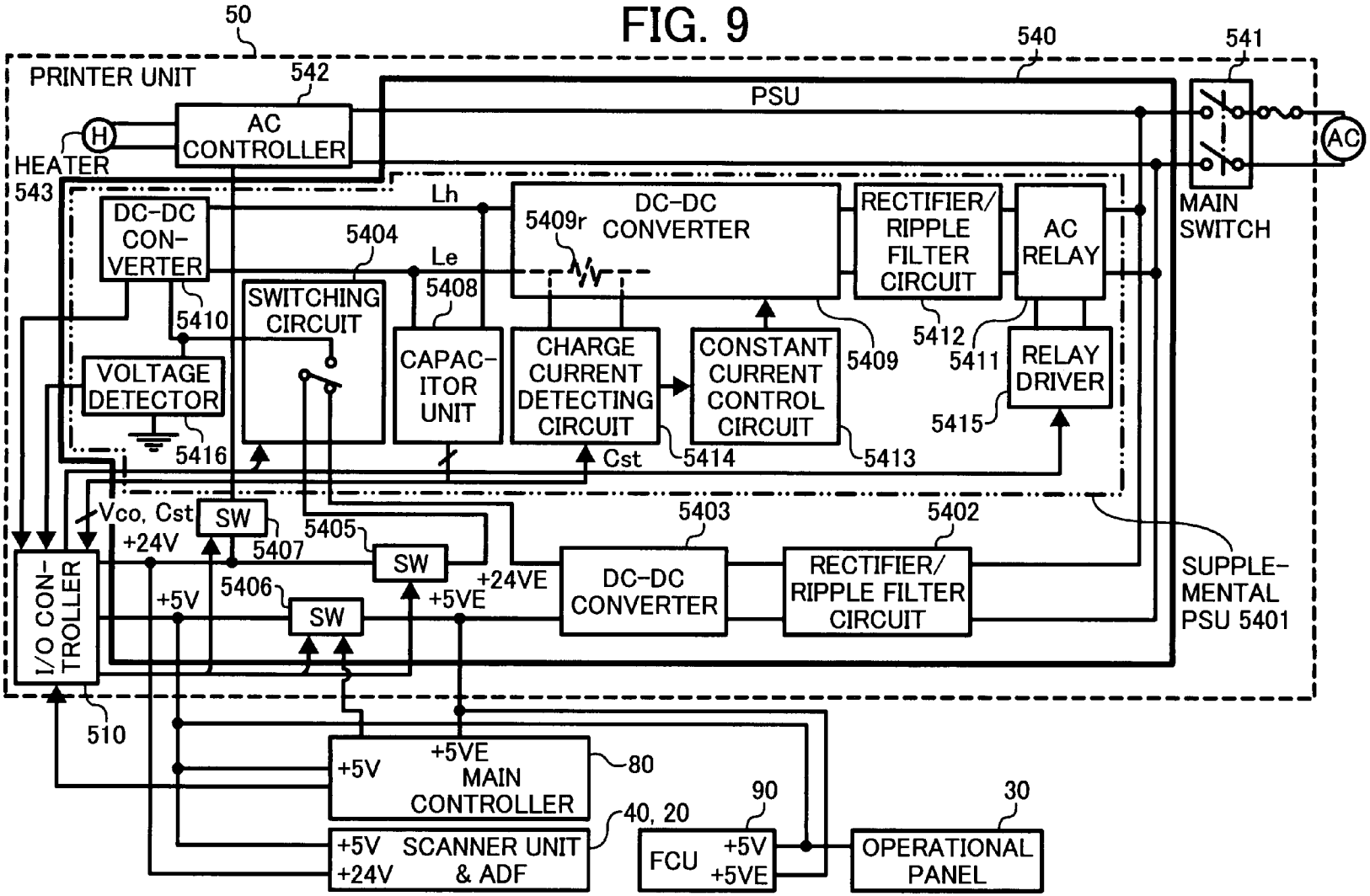
FIG. 9 is a block diagram illustrating the power supply unit shown in the FIG. 3 according to another embodiment of the invention.

FIG. 9 shows a block diagram of the PSU 540 in another embodiment. A difference between FIG. 9 and FIG. 4 is a voltage detector 5416, which detects an output voltage of the DC-DC converter 5410. So the explanations of other structures in FIG. 9 are abbreviated.

Figure 10:
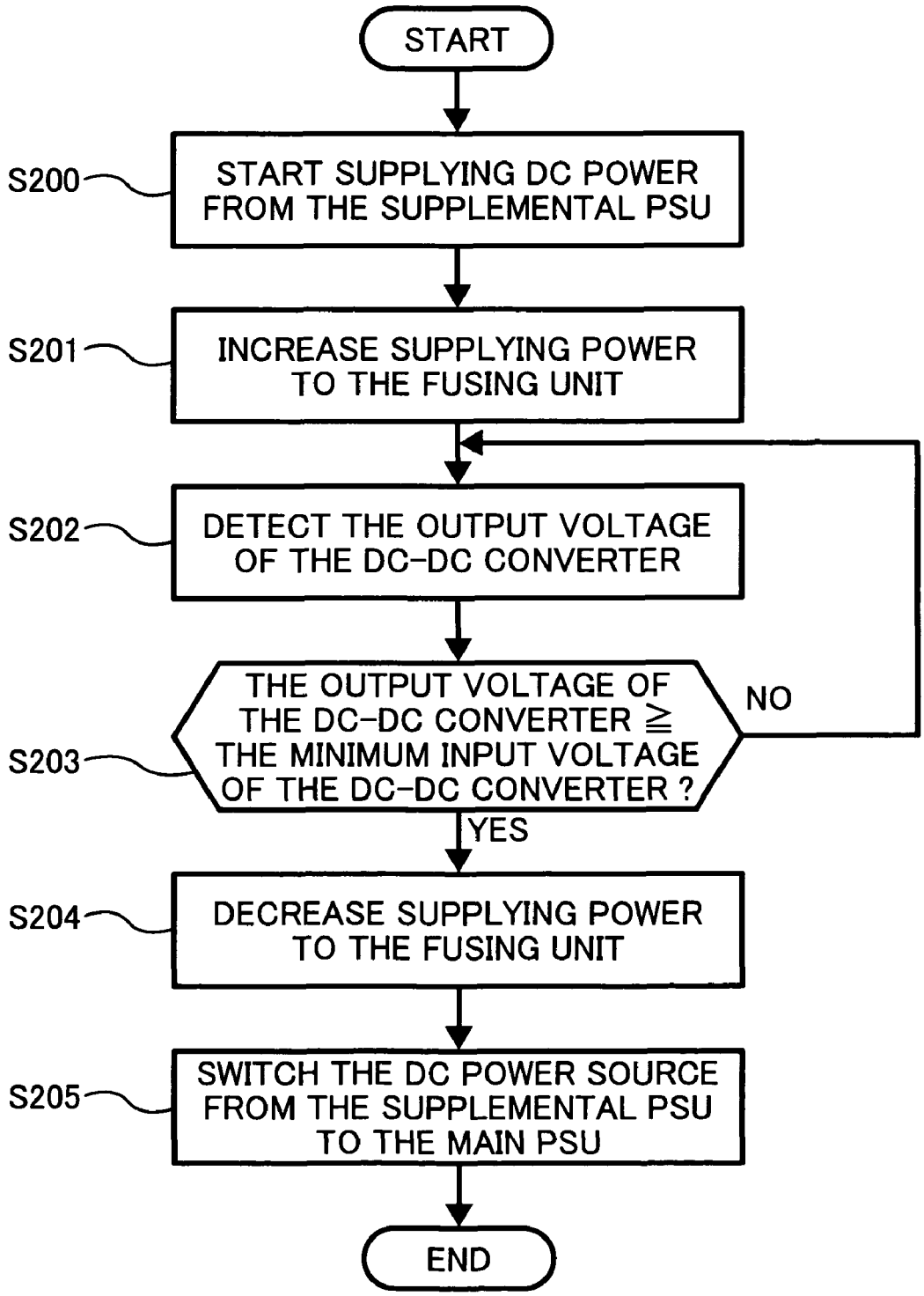
FIG. 10 is a flow chart explaining power control software according to another embodiment of the invention.

FIG. 10 is a flowchart of another embodiment of the present invention. First, the switching circuit 5404 selects the +24VE from the supplemental PSU 5401 (S200). In other words, +24VE from the DC-DC converter 5403 is not supplied to the SW 5405.

Figure 11:
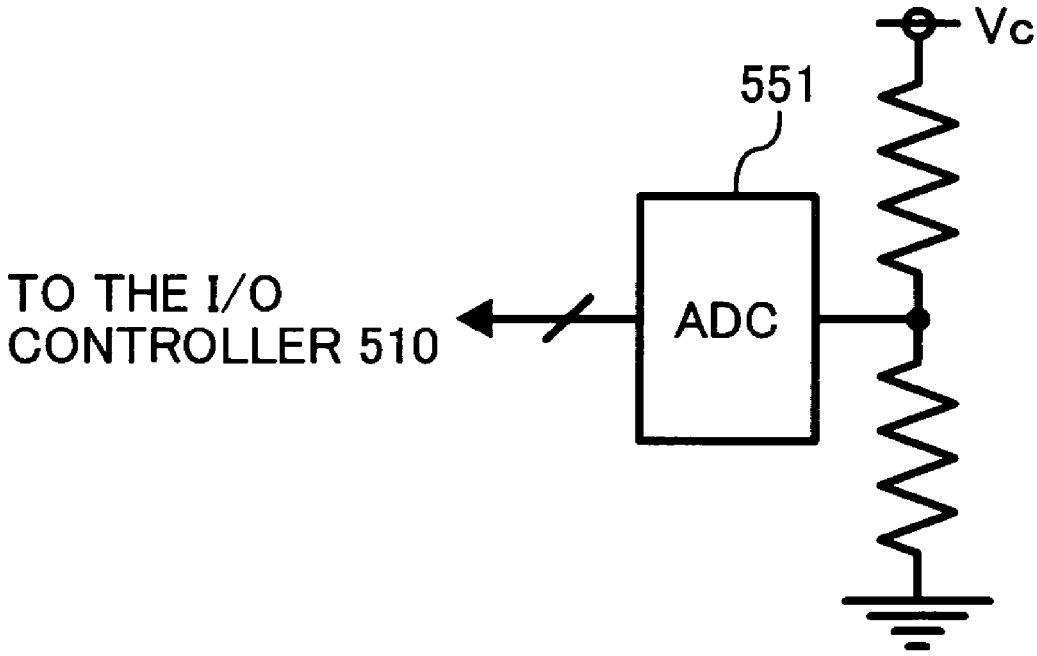
FIG. 11 is a circuit diagram illustrating a voltage detector shown in FIG. 9.

Then the AC controller 542 increases the supplying power to the heater 543 in the fusing unit 67 (S201). Therefore, the temperature of the fusing unit 67 rises and reaches the fusing temperature rapidly. While the supplemental PSU 5401 supplies +24VE, the voltage detector 5416 detects the output voltage (Vc) of the DC-DC converter 5410 (S202) and sends it to the I/O controller 510. In this embodiment, the voltage detector 5416 is constituted with two resistors, which are connected between the output line of the DC-DC converter 5410 and the ground, and divides voltage output of the DC-DC converter 5410. The divided voltage is converted to digital data by an analog-to-digital converter (not shown), which is on the I/O controller 510. In another embodiment, it is also possible that the analog-to-digital converter 551 is provided to the voltage detector 5416 and sends digital data to the I/O controller 510, as shown in FIG. 11.

The I/O controller 510 judges that the output voltage Vc is higher or equal to a minimum rating output voltage of the DC-DC converter 5410 (S203). As supplying +24VE, the capacitor unit 5408 loses the accumulated power gradually and the capacitor voltage Vco gradually become lower and causes decline of the output voltage of the DC-DC converter 5410.

When the output voltage Vc reaches the minimum rating output voltage of the DC-DC converter 5410, the AC controller 542 reduces the supplying power to the heater 543 (S204). Then the switching circuit 5404 selects the +24VE from the DC-DC converter 5403 and stops supplying +24VE from the supplemental PSU 5408 (S205).

In this embodiment, the output voltage of the DC-DC converter 5410 is detected while the DC-DC converter 5410 supplies the DC power, and the AC power for the fusing unit 67 is increased. When the output voltage drops to the predetermined voltage, the DC power for some DC loads is switched to the DC power from the DC-DC converter 5403 and the AC power for the fusing unit 67 is decreased. Therefore it is possible to supply much AC power for the fusing unit 67 and to make the warm up time and the recovery time shorter.

Figure 12:
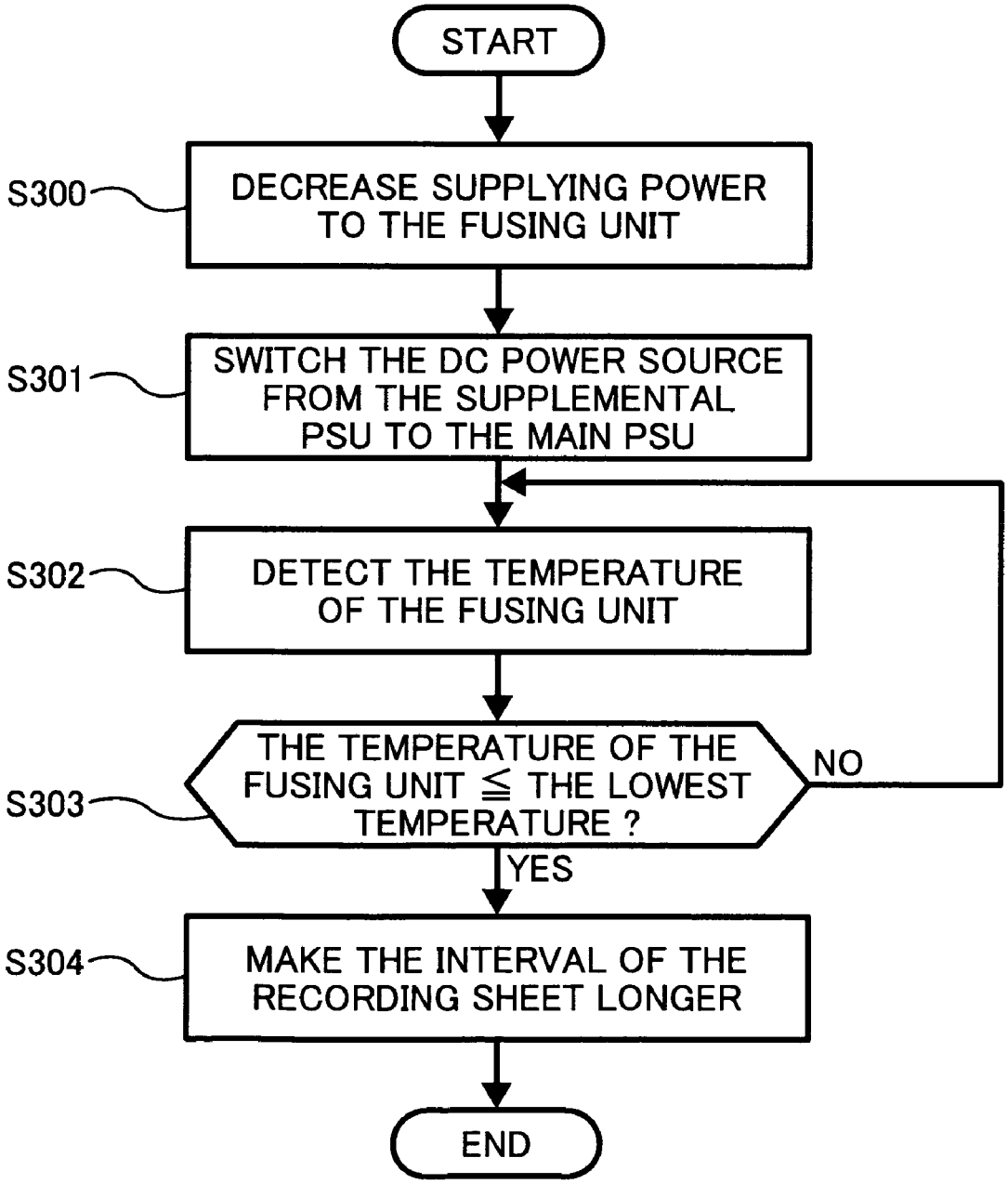
FIG. 12 is a flow chart explaining power control software according to another embodiment of the invention.

FIG. 12 shows a flow chart of another embodiment of this invention. Shown in FIG. 8 and in FIG. 10, the AC controller 542 reduces the supplying power to the heater 543 of the fusing unit 67 (S300), and the switching circuit 5404 switches +24VE from the DC-DC converter 5410 to the DC-DC converter 5403 (S301) and stops supplying +24VE from the supplemental PSU 5408.

As the AC controller 542 decreases the supplying power to the heater 543 of the fusing unit 67, based on conditions like the size of the recording sheets, the ambient temperature, and the continuous time of printing, the temperature of the fusing unit 67 may gradually decrease. When the temperature of the fusing unit 67 has decreased, then the fusing unit 67 is unable to fix the toner image to the recording sheet and it causes the degradation of the printing quality. Then the I/O controller 510 detects the temperature of the fusing unit 67 (S302) and judges when the temperature of the fusing unit 67 becomes the lowest temperature that can fix the toner image to the recording sheet, or less (S303). If the temperature of the fusing unit 67 reaches the lowest temperature, then the interval of the recording sheets is made longer (S304). As a result, the productivity declines, but it prevents the decline of the temperature of the fusing unit 67.

In this embodiment, when the temperature of the fusing unit decreases, the image forming apparatus 10 makes the interval of the recording sheets longer, so it can avoid the fixation problem.

Figure 13:
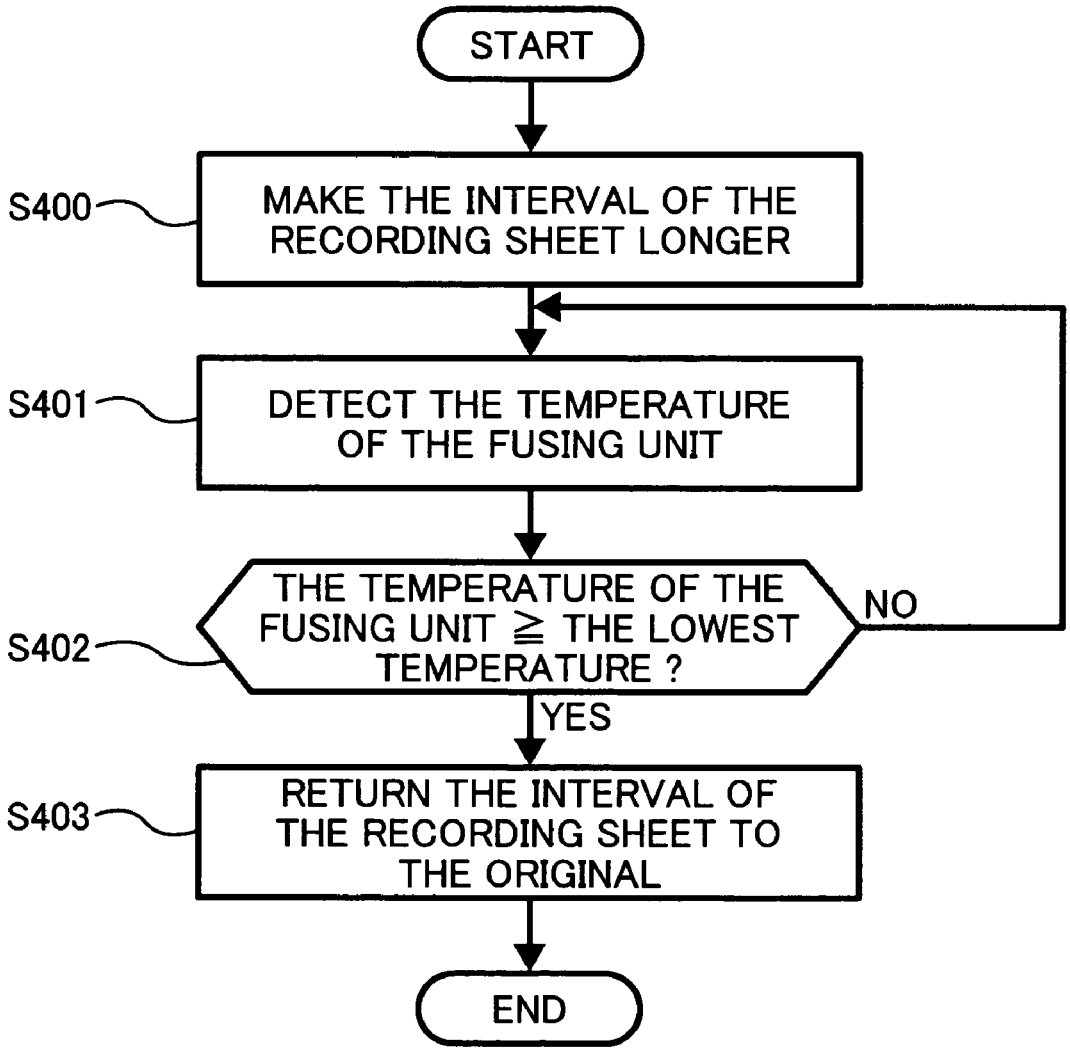
FIG. 13 is a flow chart explaining power control software according to another embodiment of the invention.

FIG. 13 shows a flow chart of another embodiment of the present invention. After the interval of the recording sheet is made longer, as shown in FIG. 12, the temperature of the fusing unit 67 may gradually rise (S400). So the I/O controller 510 continues to detect the temperature of the fusing unit 67 (S401) and judges when the temperature of the fusing unit 67 becomes the lowest temperature or higher (S402). If the temperature of the fusing unit 67 becomes higher than the lowest temperature, the interval of the recording sheets is returned to the original interval (S403) and productivity increases.

In this embodiment, the temperature at which the interval is returned (return temperature) is preferably higher than the lowest temperature.

For example, if the lowest temperature is set to 160 degrees Celsius and the return temperature is set to 170 degrees Celsius, normally the temperature of the fusing unit is kept at 170 degrees Celsius. After the AC controller 542 limits the supplying power to the heater 543, the temperature of the fusing unit 67 cannot be maintained and gradually declines. When the temperature of the fusing unit 67 reaches 160 degrees Celsius, the productivity of printing is set lower. After the productivity of printing is set lower, the temperature of the fusing unit 67 may gradually recover and reaches 170 degrees Celsius again.

In this embodiment, when the temperature of the fusing unit decreases, the image forming apparatus 10 decreases the process speed, so it can avoid the fixation problem.

Figure 14:
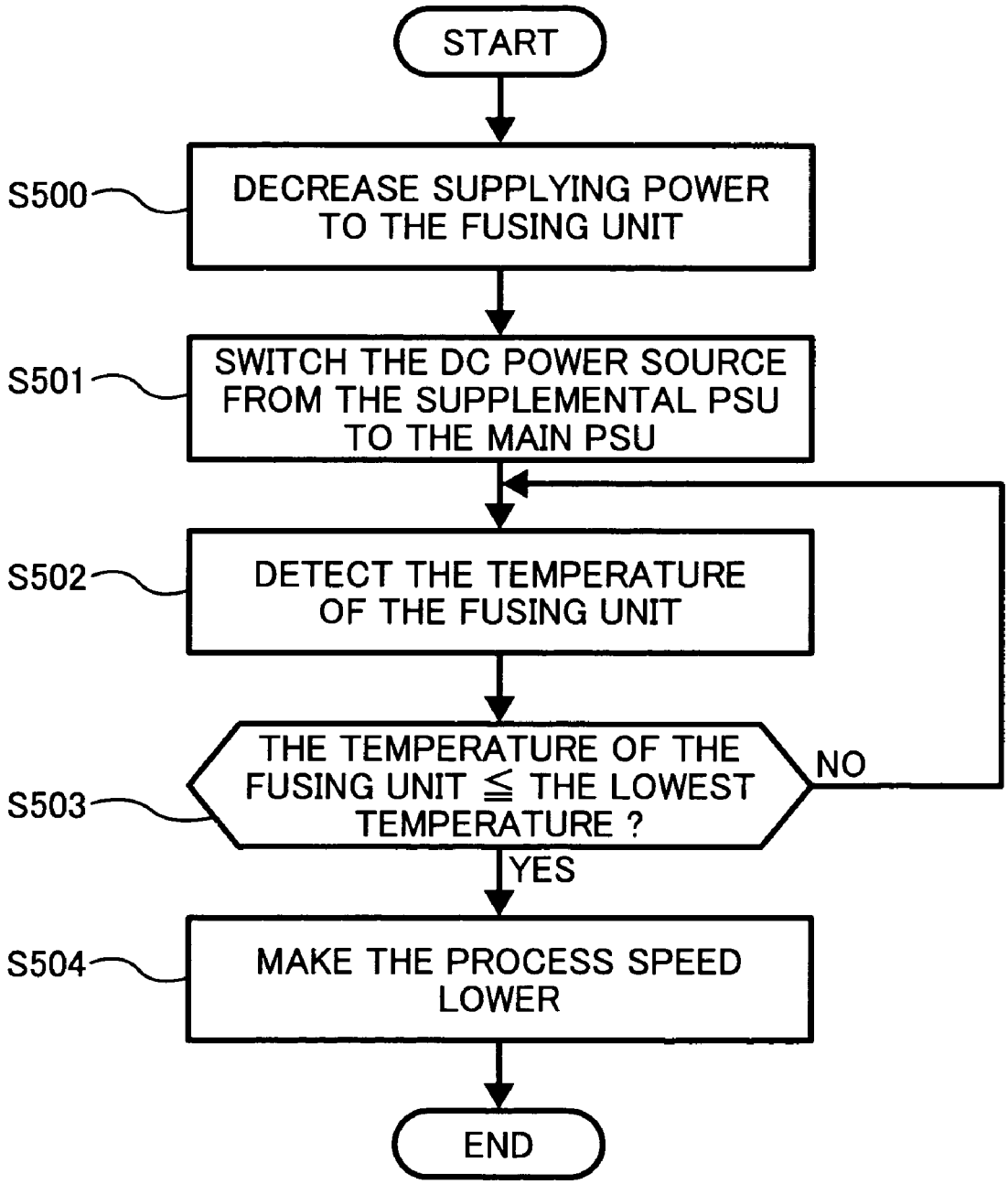
FIG. 14 is a flow chart explaining power control software according to another embodiment of the invention.

FIG. 14 shows a flow chart of another embodiment of this invention. As shown in FIG. 8 and in FIG. 10, the AC controller 542 reduces the supplying power to the heater 543 of the fusing unit 67 (S500) and the switching circuit 5404 switches +24VE from the DC-DC converter 5410 to the DC-DC converter 5403 (S501) and stops supplying +24VE from the supplemental PSU 5408.

As the AC controller 542 decreases the supplying power to the heater 543 of the fusing unit 67, based on conditions like the size of the recording sheets, the ambient temperature, and the continuous time of printing, the temperature of the fusing unit 67 may gradually decrease. When the temperature of the fusing unit 67 has decreased, the fusing unit 67 is unable to fix the toner image to the recording sheet and it causes the degradation of the printing quality. Then the I/O controller 510 detects the temperature of the fusing unit 67 (S502) and judges when the temperature of the fusing unit 67 becomes the lowest temperature, or less (S503). If the temperature of the fusing unit 67 reaches the lowest temperature, the conveying speed of the recording sheets is made slower (S504). As a result, productivity declines, but it prevents the decline of the temperature of the fusing unit 67.

In this embodiment, when the temperature of the fusing unit decrease, the image forming apparatus 10 decreases the process speed, so it can avoid the fixation problem.

Figure 15:
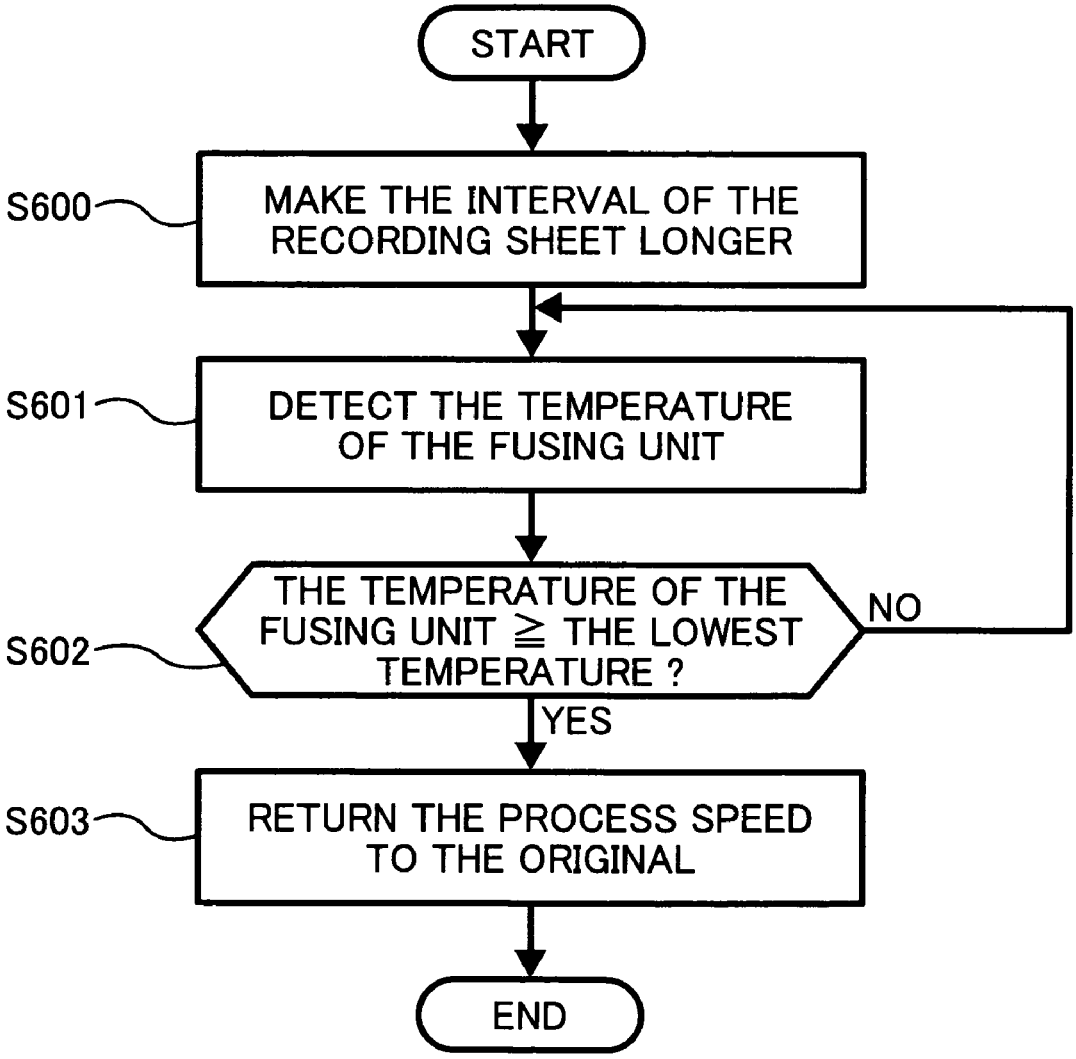
FIG. 15 is a flow chart explaining power control software according to another embodiment of the invention.

FIG. 15 shows a flow chart of another embodiment of this invention. After the conveying speed of the recording sheet is made slower, as shown in FIG. 14, the temperature of the fusing unit 67 may gradually rise (S600). So the I/O controller 510 continues to detect the temperature of the fusing unit 67 (S601) and judges when the temperature of the fusing unit 67 becomes the lowest temperature or higher (S602). If the temperature of the fusing unit 67 becomes higher than the lowest temperature, the conveying speed of the recording sheets is returned to the original speed (S603) and the productivity increases.

In this embodiment, the return temperature is preferably higher than the lowest temperature.

In this embodiment, when the temperature of the fusing unit recovers, the image forming apparatus 10 returns to the normal process speed, so it can raise productivity of the image forming apparatus 10 without causing the fixation problem.

Figure 16:
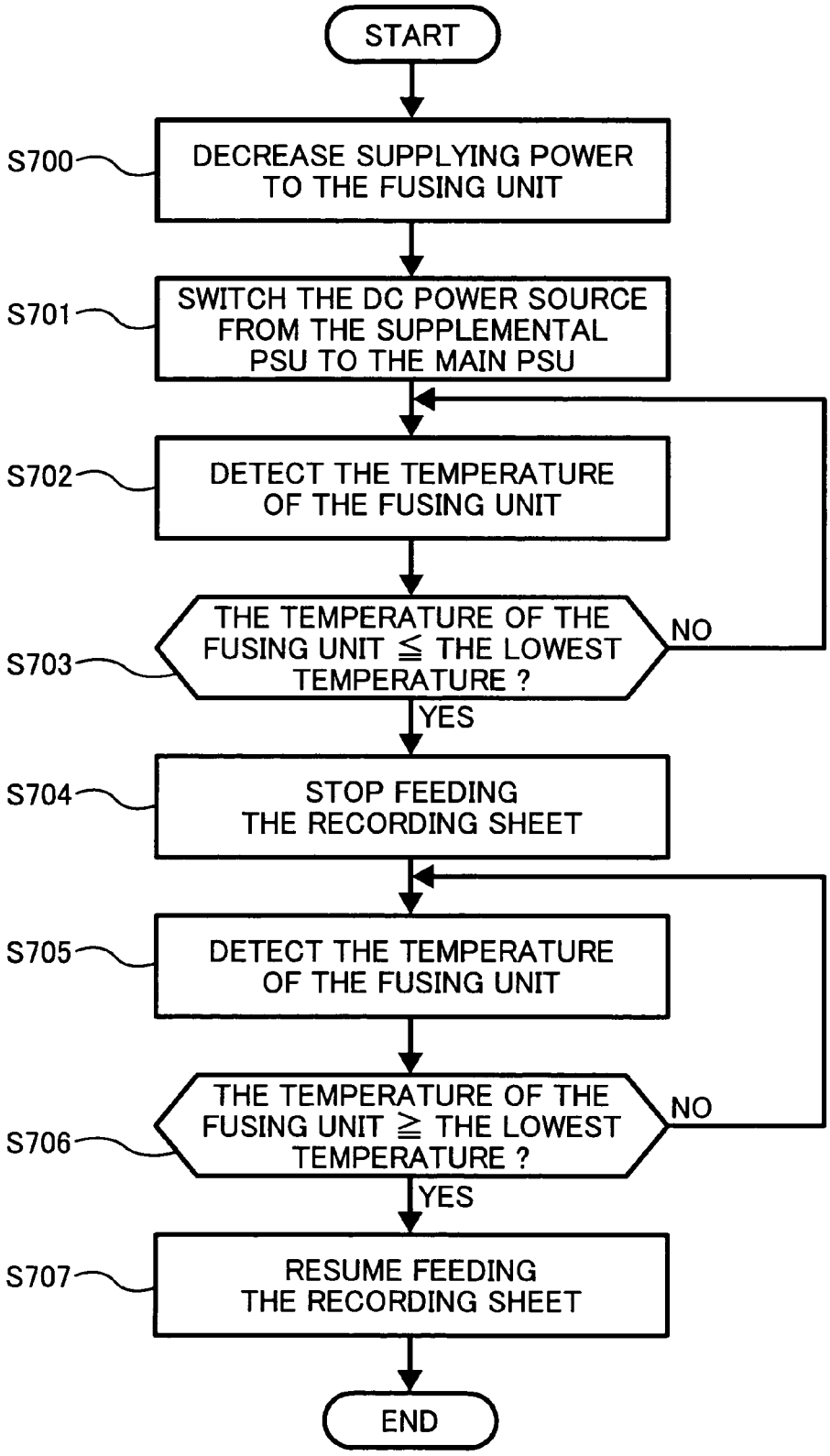
FIG. 16 is a flow chart explaining power control software according to another embodiment of the invention.

FIG. 16 shows a flow chart of another embodiment of this invention. As shown in FIG. 8 and FIG. 10, the AC controller 542 reduces the supplying power to the heater 543 of the fusing unit 67 (S700) and the switching circuit 5404 switches +24VE from the DC-DC converter 5410 to the DC-DC converter 5403 (S701) and stops supplying +24VE from the supplemental PSU 5408.

As the AC controller 542 decreases the supplying power to the heater 543 of the fusing unit 67, based on conditions like the size of the recording sheets, the ambient temperature, and the continuous time of printing, the temperature of the fusing unit 67 may gradually decrease. When the temperature of the fusing unit 67 has decreased, the fusing unit 67 is unable to fix the toner image to the recording sheet and it causes the degradation of the printing quality. Then the I/O controller 510 detects the temperature of the fusing unit 67 (S702) and judges when the temperature of the fusing unit 67 becomes the lowest temperatures or less (S703). If the temperature of the fusing unit 67 reaches the lowest temperature, the feeding the recording sheets is stopped (S704). As a result, the productivity declines, but it prevents the decline of the temperature of the fusing unit 67.

After stopping the feeding of the recording sheets, the I/O controller 510 continues to detect the temperature of the fusing unit 67 (S705) and judges when the temperature of the fusing unit 67 becomes the lowest temperature or higher (S706). If the temperature of the fusing unit 67 becomes higher than the lowest temperature, the feeding of the recording sheets is resumed (S707).

In this embodiment, the return temperature is preferably higher than the lowest temperature.

In this embodiment, when the temperature of the fusing unit decreases, the image forming apparatus 10 stops feeding the recording sheet, so it can avoid the fixation problem.

FIGS. 17 and 18 are tables showing examples of the relationship between the average necessary power for the heater 543 and the interval of the recording sheets or the conveying speed of the recording sheet under the disadvantageous condition for fusing. As these tables illustrate, making the productivity lower causes a decline of the average necessary power. Accordingly, the average necessary power without the degradation of the printing quality can be lower under the lower productivity.

Figure 19:
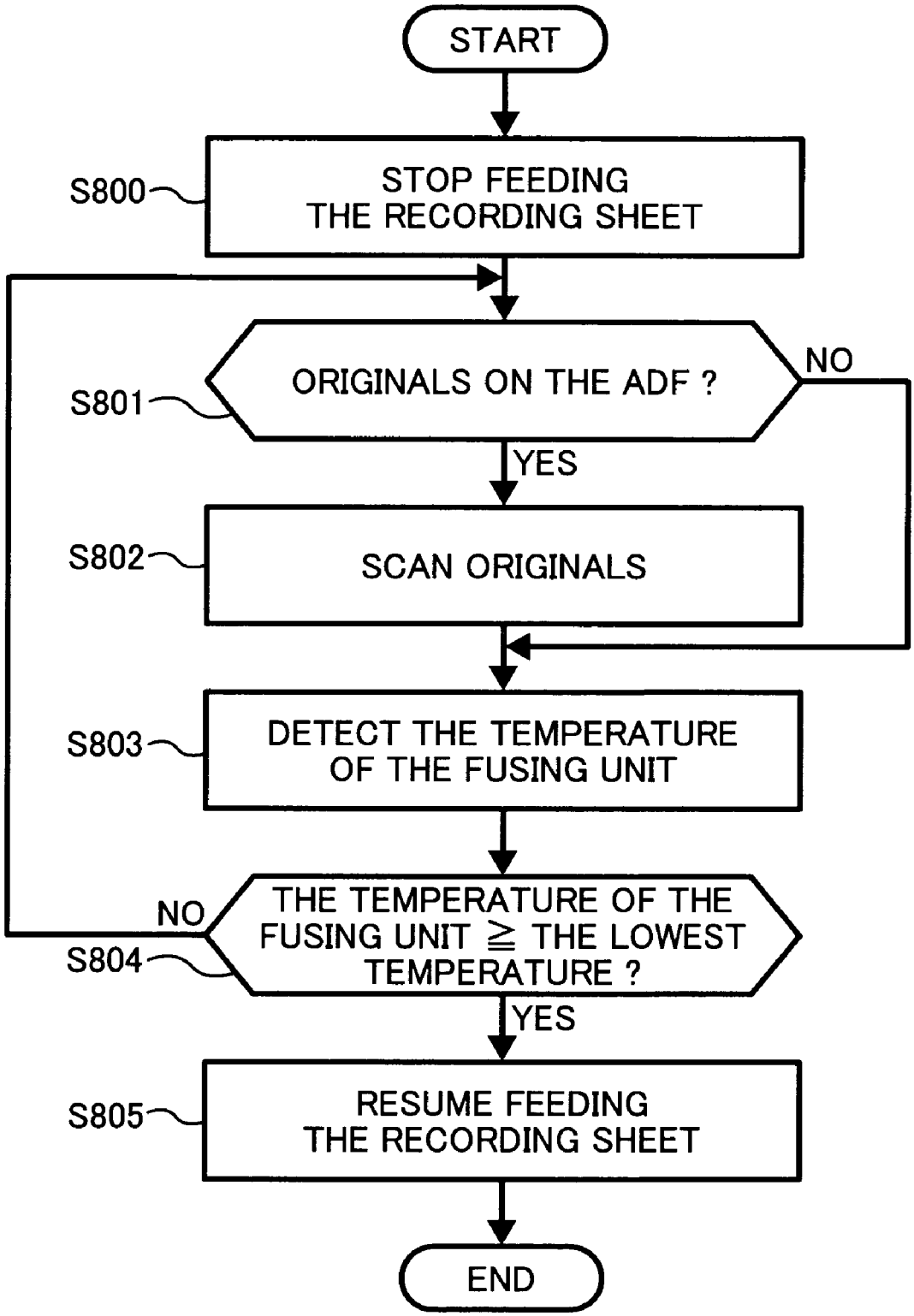
FIG. 19 is a flow chart explaining power control software according to another embodiment of the invention.

FIG. 19 shows a flow chart of another embodiment of this invention. After stopping the feeding of the recording sheet (S800) as shown in FIG. 16, the engine controller 501 judges whether the original is on the ADF 20 or not by the original detecting sensor 21 (S801). If the original is on the ADF 20, the scanning is possible regardless the temperature of the fusing unit 67 so the engine controller 501 starts scanning by the scanner unit 40 (S802). Then the I/O controller 510 continues to detect the temperature of the fusing unit 67 (S803) and judges when the temperature of the fusing unit 67 becomes the lowest temperature or higher (S804). If the temperature of the fusing unit 67 becomes higher than the lowest temperature, the feeding of the recording sheets is resumed (S805).

In this embodiment, even stopping the sheet feeding and recovering the temperature of the fusing unit, the image forming apparatus 10 continues to scan the originals so the operator can use the image forming apparatus 10 efficiently.

Numerous additional modifications and variations are possible in a light of the above teachings. It is therefore to be understood that within the scope of the appended claims, the present invention may be practiced otherwise than as specifically described herein.

The invention claimed is:

1. A image forming apparatus, comprising:

a plurality of DC-powered units;

a fusing unit;

a main power supply unit configured (1) to convert an AC power source into an AC power and a first DC power, (2) to provide the AC power to the fusing unit, and (3) to provide the first DC power to the plurality of DC-powered units;

a supplemental power supply unit configured to accumulate the AC power from the AC power source and to provide a second DC power to the plurality of DC-powered units for a predetermined period, the supplemental power unit comprising a DC-to-DC converter configured to convert an accumulated DC power to the second DC power; and a voltage detector configured to detect a voltage of the accumulated DC power; and a controller configured (1) to reduce the AC power to be provided to the fusing unit, (2) to stop the second DC power to be supplied to the plurality of DC-powered units, and (3) to start the first DC power to be supplied to the plurality of DC-powered units, when the voltage detector detects that the accumulated DC power has dropped below a predetermined level.

2. The image forming apparatus according to claim 1, further comprising:

a temperature detector configured to detect a temperature of the fusing unit; and an image forming controller configured to control productivity of the image forming apparatus, wherein the image forming controller is configured to decrease the productivity when the voltage detector detects that the accumulated DC power has dropped below the predetermined level.

3. The image forming apparatus according to claim 2, wherein the image forming controller is configured to decrease the productivity by increasing an interval of recording on a recording sheet.

4. The image forming apparatus according to claim 2, wherein the image forming controller is configured to decrease productivity by decreasing a process speed.

5. The image forming apparatus according to claim 2, wherein the image forming controller is configured to decrease the productivity by stopping feeding of a recording sheet so as to recover the temperature of the fusing unit.

6. The image forming apparatus according to claim 5, further comprising:

a scanner configured to scan originals when the image forming controller recovers the temperature of the fusing unit.

7. A image forming apparatus, comprising:

a plurality of DC-powered units;

a fusing unit;

a main power supply unit configured (1) to convert an AC power source into an AC power and a first DC power, (2) to provide the AC power to the fusing unit, and (3) to provide the first DC power to the plurality of DC-powered units;

a supplemental power supply unit configured to accumulate the AC power from the AC power source and to provide a second DC power to the plurality of DC-powered units for a predetermined period, the supplemental power unit comprising a DC-to-DC converter configured to convert an accumulated DC power to the second DC power; and a voltage detector which detects the output voltage of the DC-to-DC converter; and a controller configured (1) to reduce the AC power to be provided to the fusing unit, (2) to stop the second DC power to be supplied to the plurality of DC-powered units, and (3) to start the first DC power to be supplied to the DC loads, when the voltage detector detects that the output voltage of the DC-to-DC converter has dropped below a predetermined level.

8. The image forming apparatus according to claim 7, further comprising:

a temperature detector configured to detect a temperature of the fusing unit; and an image forming controller configured to control productivity of the image forming apparatus, wherein the image forming controller is configured to decrease the productivity when the voltage detector detects that the output voltage has dropped below the predetermined level.

9. The image forming apparatus according to claim 8, wherein the image forming controller is configured to decrease the productivity by increasing an interval of recording on a recording sheet.

10. The image forming apparatus according to claim 8, wherein the image forming controller is configured to decrease the productivity by decreasing a process speed.

11. The image forming apparatus according to claim 8, wherein the image forming controller is configured to decrease the productivity by stopping feeding of a recording sheet so as to recover the temperature of the fusing unit.

12. The image forming apparatus according to claim 11, further comprising:

a scanner configured to scan originals when the image forming controller recovers the temperature of the fusing unit.

13. A method of controlling an image forming apparatus, comprising:

converting an AC power source into an AC power and a first DC power;

providing the AC power to a fusing unit;

providing the first DC power to a plurality of DC-powered units;

converting an accumulated DC power to a second DC power;

providing the second DC power to the plurality of DC-powered units for a predetermined period;

detecting a voltage;

when the detecting step detects that the voltage has dropped below a predetermined level, (1) reducing the AC power provided to the fusing unit, (2) stopping the second DC power to be supplied to the plurality of DC-powered units, and (3) starting the first DC power to be supplied to the plurality of DC-powered units.

14. The method of claim 13, wherein the detecting step comprises:

detecting a voltage of the a DC-to-DC converter used to convert the accumulated DC power to the second DC power.

15. The method of claim 13, wherein the detecting step comprises:

detecting, by a voltage detector, a voltage of the accumulated DC power as the detected voltage.

16. The method of claim 15, further comprising:

detecting a temperature of the fusing unit; and decreasing the productivity of the image forming apparatus when the voltage detector detects that the accumulated DC power has dropped below the predetermined level.

17. The method of claim 16, wherein the decreasing step comprises:

decreasing the productivity by increasing an interval of recording on a recording sheet.

18. The method of claim 16, wherein the decreasing step comprises:

decreasing productivity by decreasing a process speed.

19. The method of claim 16, wherein the decreasing step comprises:

decreasing the productivity by stopping feeding of a recording sheet so as to recover the temperature of the fusing unit.

20. The method of claim 19, further comprising:

scanning originals when the temperature of the fusing unit is recovered.

* * * * *